US006768887B2

(12) United States Patent
Mikita et al.

(10) Patent No.: US 6,768,887 B2
(45) Date of Patent: Jul. 27, 2004

(54) FUNCTIONAL UNIT SUPPORT MECHANISM AND IMAGE FORMING APPARATUS PROVIDED WITH THE SUPPORT MECHANISM

(75) Inventors: Toshiya Mikita, Yao (JP); Yoshinobu Tateishi, Nara (JP); Yasunori Minakuchi, Nara (JP); Kazuhiro Matsuyama, Ikoma (JP); Atsushi Ide, Nara (JP); Toshio Yamanaka, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/443,805

(22) Filed: May 23, 2003

(65) Prior Publication Data

US 2003/0219277 A1 Nov. 27, 2003

(30) Foreign Application Priority Data

May 24, 2002 (JP) ..... 2002-150813

(51) Int. Cl.[7] ..... G03G 15/20
(52) U.S. Cl. ..... 399/122
(58) Field of Search ..... 399/122, 320, 399/328; 219/216

(56) References Cited

U.S. PATENT DOCUMENTS 5,111,248 A * 5/1992 Kita et al. ..... 399/122
5,579,098 A * 11/1996 Noguchi et al. ..... 399/122
2003/0099476 A1 * 5/2003 Minakuchi et al. ..... 399/21

FOREIGN PATENT DOCUMENTS

| | | |
|---|---|---|
| JP | 62-4770 U | 1/1987 |
| JP | 64-080979 A | 3/1989 |
| JP | 5-314688 A | 12/1993 |

* cited by examiner

*Primary Examiner*—Quana Grainger
(74) *Attorney, Agent, or Firm*—Birch, Stewart, Kolasch & Birch, LLP

(57) ABSTRACT

A base plate detachably supports a functional unit all the way between an exposed position where the functional unit is separated from a connector and drawn out of a housing of an image forming apparatus such that the functional unit is exposed to the exterior of the housing and an accommodated position where the functional unit is fitted in the housing and connected to the connector. A biasing member biases a threaded shaft of an operating device through the base plate such that a far end of the threaded shaft is directed toward a threaded hole formed in the bottom of the functional unit. The operating device is hidden inside the housing of the apparatus when the base plate is set to the accommodated position.

10 Claims, 6 Drawing Sheets

PRIOR ART

PRIOR ART

FUNCTIONAL UNIT SUPPORT MECHANISM AND IMAGE FORMING APPARATUS PROVIDED WITH THE SUPPORT MECHANISM

BACKGROUND OF THE INVENTION

1. Field of the Invention

The present invention relates to a support mechanism for detachably supporting a fixing unit (fuser unit) or other functional units of an image forming apparatus, such as a copy machine, inside the apparatus, as well as to an image forming apparatus employing such a support mechanism.

2. Description of the Related Art

A copy machine, a conventionally known example of an image forming apparatus, works as follows. As shown in FIG. 5, an original document (not shown) placed on platen glass 21 is scanned by an optical unit 22 to produce a latent image corresponding to an image on the document on a photosensitive drum 23. A developing unit 24 convert the latent image into a visual image through an electrostatic process.

The visual image thus produced is transferred onto a sheet of copying paper (not shown) fed from a paper cassette 25 and fused, or fixed, onto the copying paper by a fuser unit 26. A final copy is then discharged from the copy machine. During execution of overall image forming process mentioned above, a fan (not shown) provided on one side of a housing 27 of the copy machine is run to prevent temperature increase inside the housing 27.

Referring to FIGS. 5 and 6, the fuser unit 26 is constructed such that a pressure roller 31 supported by a bracket 30 is pressed by an elastic pushing force exerted by a coil spring 32 against a fuser roller 29 rotating in a frame 28. Surfaces of the fuser roller 29 and the pressure roller 31 are securely pressed against each other in this fashion.

In this construction, the pushing force of the pressure roller 31 exerted against the fuser roller 29 is regulated by varying the amount of displacement of the coil spring 32. Specifically, the amount of displacement of the coil spring 32 is changed by varying the amount of its elastic deformation (compression and extension) by turning a screw 34 fitted in a base plate 33 provided at the bottom of the frame 28 in an appropriate direction. Japanese Laid-open Patent Publication No. S64-80979 and Japanese Laid-open Utility Model Publication No. S62-4770, for example, disclose fuser units constructed as described above.

The conventional fuser unit of the aforementioned construction, however, has a problem that its assembling efficiency and maintainability are poor and it is difficult to visually identify the screw 34 which is used as an operating device, because it is so small and positioned at the bottom of the base plate 33.

On the other hand, Japanese Laid-open Patent Publication No. H5-341688 discloses an image forming apparatus employing a method of regulating a pushing force of a pressure roller exerted against a heating roller by moving up and down a fixture which is held in contact with an end surface of an operating device formed in the shape of a helical cam surface and provided at a lower side portion of a frame by turning the operating device in an appropriate direction, thereby varying the amount of displacement of a coil spring supporting both ends of a frame of a fuser unit upward.

According to this construction, it is possible to manipulate the operating device from outside as it is exposed to the exterior of the apparatus on one side surface of its housing and, therefore, maintainability of the fuser unit in regulating its pushing force is improved due to improvements in visibility of the operating device and its operability.

The aforementioned method of regulating the pushing force of the pressure roller proposed in Japanese Laid-open Patent Publication No. H5-341688 carries a risk of degrading print quality. This is because part of the operating device is exposed to the exterior of the apparatus and, therefore, an operator may inadvertently turn the operating device, thereby causing an unintended change in fixing conditions.

As a result of a recent reduction in size and growing demand for personal use of image forming apparatus as well as a tendency to implement modular design, manufacturers have started to market image forming apparatus incorporating customer replaceable units (CRUs) to meet customer requirements for a higher serviceability ratio and a reduction in down time. This CRU design concept permits customers to replace individual units (CRUs) by themselves without the need to ask for servicing by qualified personnel.

In the design of the image forming apparatus which are expected to be used in the aforementioned fashion, attention should be paid not only to ease of installation and adjustment of the fuser unit but also to methods of installation and fixing of an image forming unit and other functional units. More specifically, due consideration should be given to ease of installation and safety as well as to visibility of operating devices for securing the individual functional units and reliability of the image forming apparatus after installation of the individual functional units.

SUMMARY OF THE INVENTION

In view of the foregoing, it is an object of the invention to provide such a support mechanism for detachably supporting functional units including an image forming unit in an image forming apparatus that makes it possible to design the functional units as modularized customer replaceable units (CRUS) and offer enhanced ease and safety of installation work together with improved operability and visibility of an operating device for securing the individual functional units as well as reliability after installation of the functional units. It is another object of the invention to provide an image forming apparatus employing such a support mechanism.

According to the invention, a support mechanism for detachably supporting a functional unit in a connection bay formed in a housing of an apparatus includes a base plate for supporting the functional unit, an operating device which is provided on the bottom of the base plate and can be freely turned, a threaded shaft provided as an integral part of the operating device, a threaded hole formed in the bottom of the functional unit to allow the threaded shaft to be screwed in to secure the functional unit to the base plate, and a biasing member elastically forcing the threaded shaft toward the threaded hole. The base plate detachably supports the functional unit all the way between an exposed position where the functional unit is separated from and drawn out of the connection bay such that the functional unit is exposed to the exterior of the housing and an accommodated position where the functional unit is fitted in the connection bay. The biasing member biases the threaded shaft through the base plate such that a far end of the threaded shaft is guided toward the threaded hole, and the operating device is hidden inside the housing of the apparatus when the base plate is set to the accommodated position.

In the earlier-mentioned conventional fuser unit, part of the operating device is exposed to the exterior of the apparatus and, therefore, an operator may inadvertently turn the operating device, thereby causing an unintended change in fixing conditions and eventually resulting in degradation in print quality. Accordingly, it has conventionally been desired to solve this problem. Especially when it is intended to make an image forming unit, or other functional unit, customer replaceable, due consideration should be given to the efficiency and safety of installation work, visibility of the operating device for securing the unit, as well as reliability after installation of the unit.

In the aforementioned construction of the invention, the far end of the threaded shaft is biased by the biasing member toward the threaded hole formed in the bottom of the functional unit when the functional unit is placed on the base plate drawn out to the exterior of the housing of the apparatus. Therefore, the threaded shaft can be securely fitted into the threaded hole by simply turning the operating device, making it possible to fix the functional unit to the base plate with enhanced ease and reliability.

Also, installation of the functional unit can be easily finished by pushing in the base plate into the housing of the apparatus, thereby joining the functional unit to the connection bay. Also, the base plate can be easily drawn out of the housing, thereby disconnecting the functional unit from the connection bay at the same time, and the functional unit can be removed by just turning the operating device whenever necessary. This construction enables implementation of the CRU design concept, facilitating maintenance by the user.

Since the operating device is hidden inside the housing of the apparatus when the functional unit is pushed into the housing, no user intervention to the operating device occurs during the operation of the apparatus. This serves to prevent system failures or malfunction due to inadvertent manipulation of the operating device and keep the functional unit installed in position in a stable manner, thereby enhancing the reliability of the apparatus.

Furthermore, since the peripheral part of the operating device extends outward beyond the side surface of the functional unit, the user or servicing personnel can easily distinguish the operating device from above when the functional unit has been drawn out of the housing of the apparatus. The enhanced visibility of the operating device serves to improve labor efficiency in maintenance work.

These and other objects, features and advantages of the invention will become more apparent upon reading the following detailed description along with the accompanying drawings.

DESCRIPTION OF THE INVENTION

A functional unit support mechanism and an electrophotographic image forming apparatus employing the support mechanism according to a preferred embodiment of the invention are now described with reference to the accompanying drawings.

Figure 1:
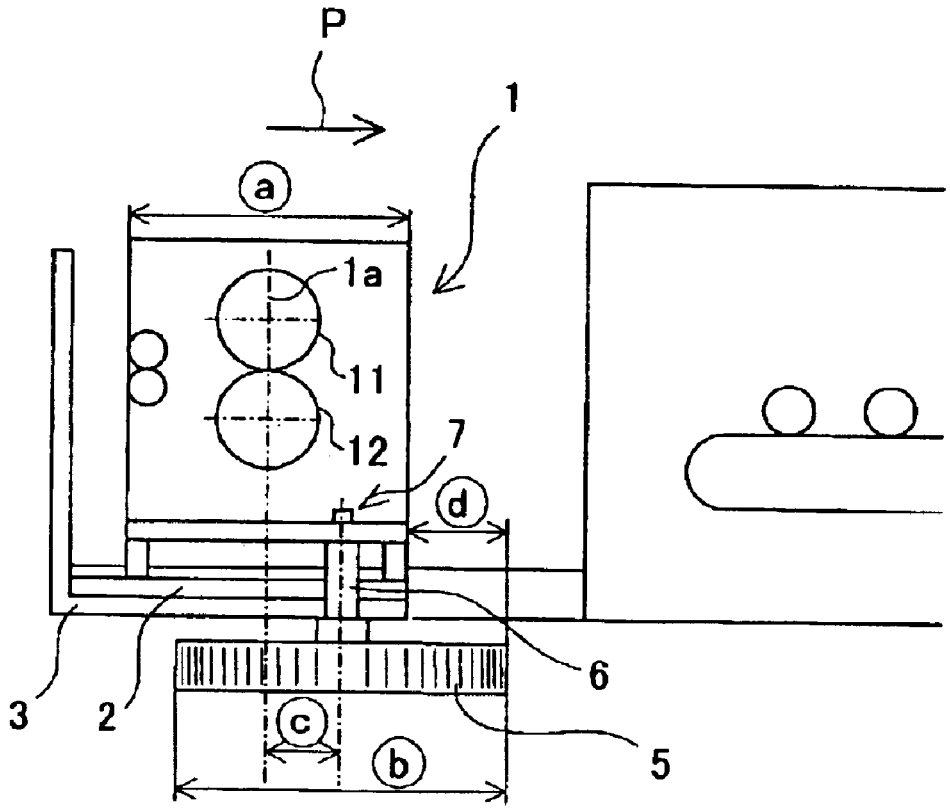
FIG. 1 is a diagram showing a state in which a functional unit has been drawn out of an image forming apparatus.

FIG. 1 is a diagram showing a state in which a base plate 2 supporting a fuser unit (customer replaceable functional unit) 1 has been drawn out to one side (left side as illustrated) of the image forming apparatus for replacement of the fuser unit 1, for example. Front and rear ends of the base plate 2 lie on two guides 3 located parallel to each other close to front and rear sides of a housing (not shown in FIG. 1) of the image forming apparatus, respectively. In FIG. 1, the reference numeral 11 designates a heating roller and the reference numeral 12 designates a pressure roller.

A far end of a threaded shaft 6 formed as an integral part of an operating device 5 is passed through the base plate 2 from its bottom side to top side and fitted into a threaded hole 7 formed in the bottom of the fuser unit 1 to fix it to base plate 2.

As can be seen from FIG. 1, the threaded hole 7 is slightly offset from a vertical center axis 1*a* of the fuser unit 1 in a direction P in which the base plate 2 is pushed in, and a peripheral part of the operating device 5 formed integrally with the threaded shaft 6 which is screwed into the threaded hole 7 extends outward beyond a side surface of the fuser unit 1.

More particularly, a central axis line of the threaded shaft 6 and the threaded hole 7 is offset from the vertical center axis 1*a* of the fuser unit 1 in the direction P in which the base plate 2 is pushed in by as much as a distance c, and the diameter d of the operating device 5 is larger than the width a of the fuser unit 1, the peripheral part of the operating device 5 extending outward beyond the side surface of the fuser unit 1 by as much as a distance d.

As the peripheral part of the operating device 5 extends outward beyond the side surface of the fuser unit 1 in this fashion, it is possible to easily identify the peripheral part of the operating device 5 from above due to its enhanced visibility when the base plate 2 has been drawn out to the exterior of the housing of the apparatus. This enables a user or servicing personnel to promptly start replacement of, or other work on, the functional unit.

Figure 4A:
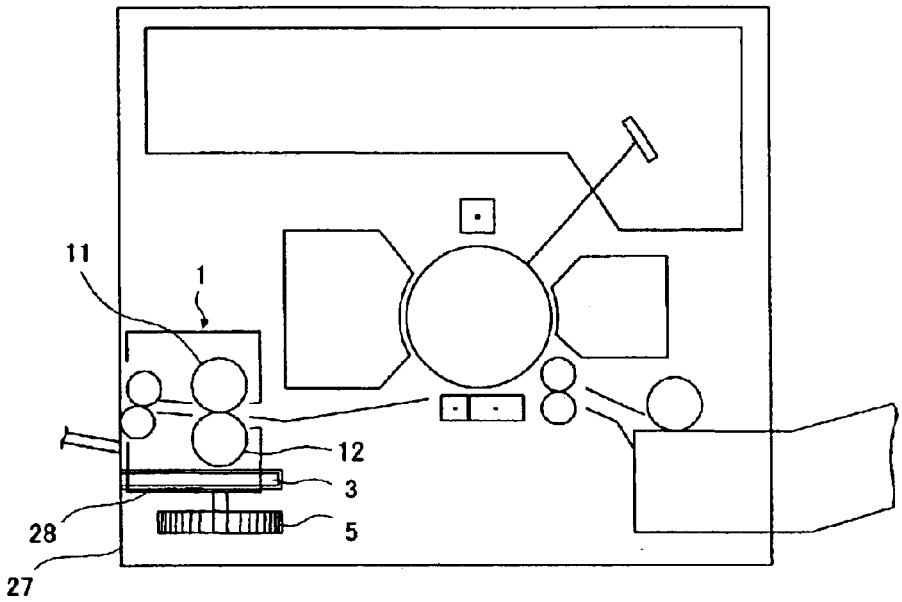
FIGS. 4A and 4B are explanatory diagrams showing a state in which the functional unit is accommodated inside the image forming apparatus and a state in which the functional unit has been drawn out of the image forming apparatus, respectively.
Figure 4B:
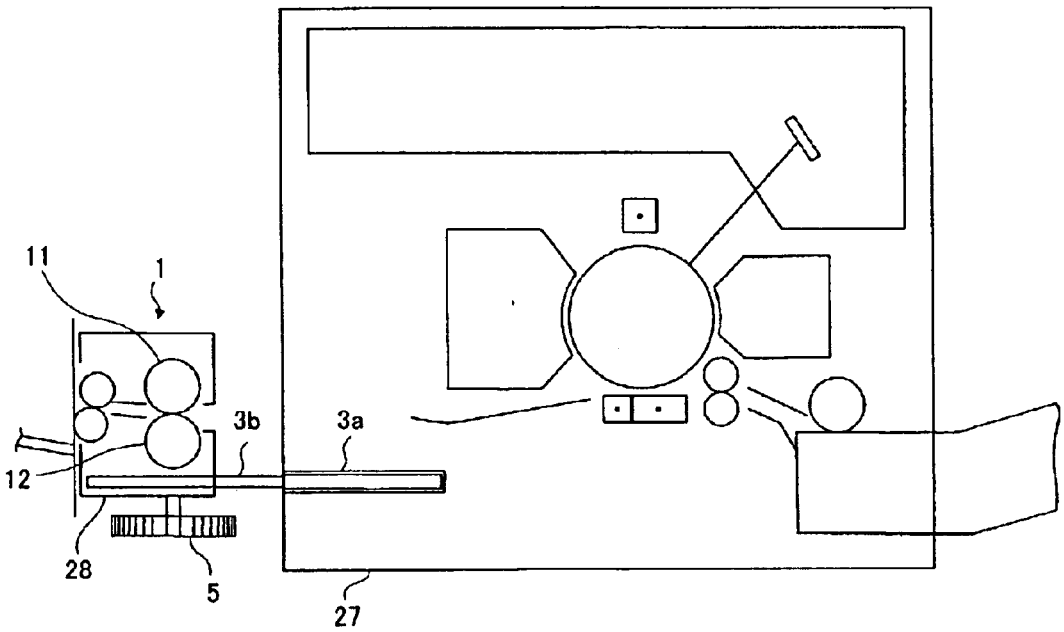
Figure 5:
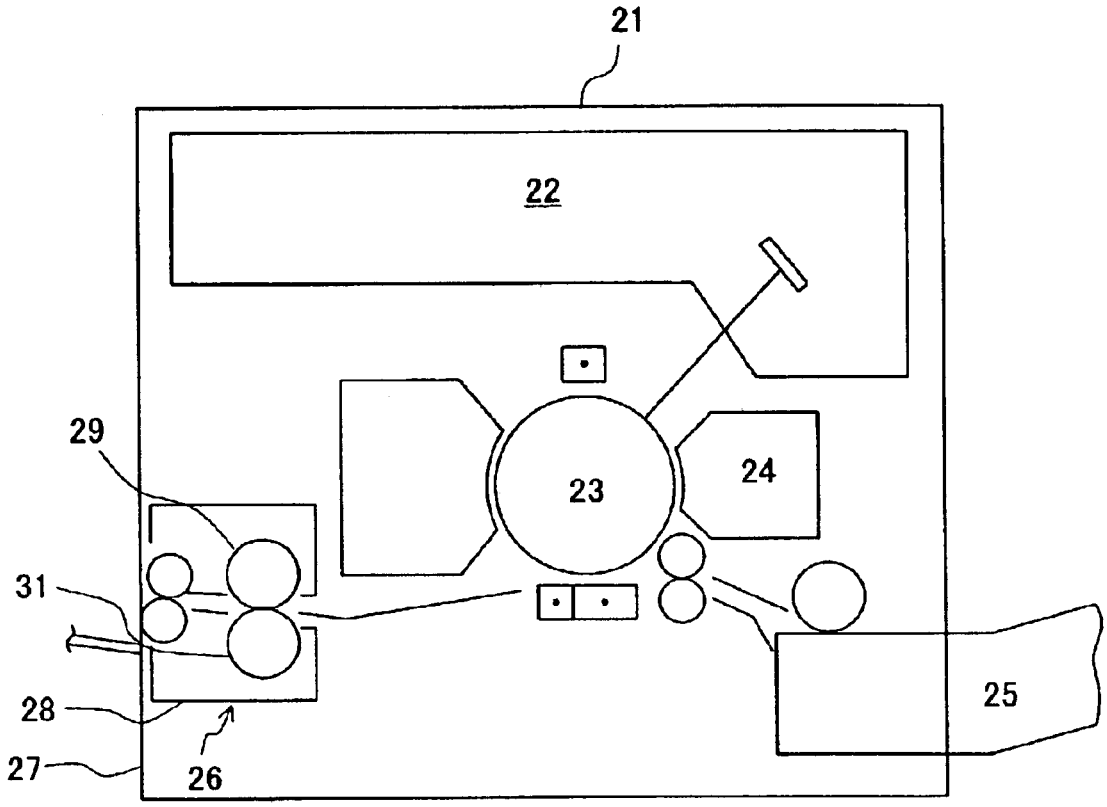
FIG. 5 is a schematic sectional view showing the construction of a conventional image forming apparatus.
Figure 6:
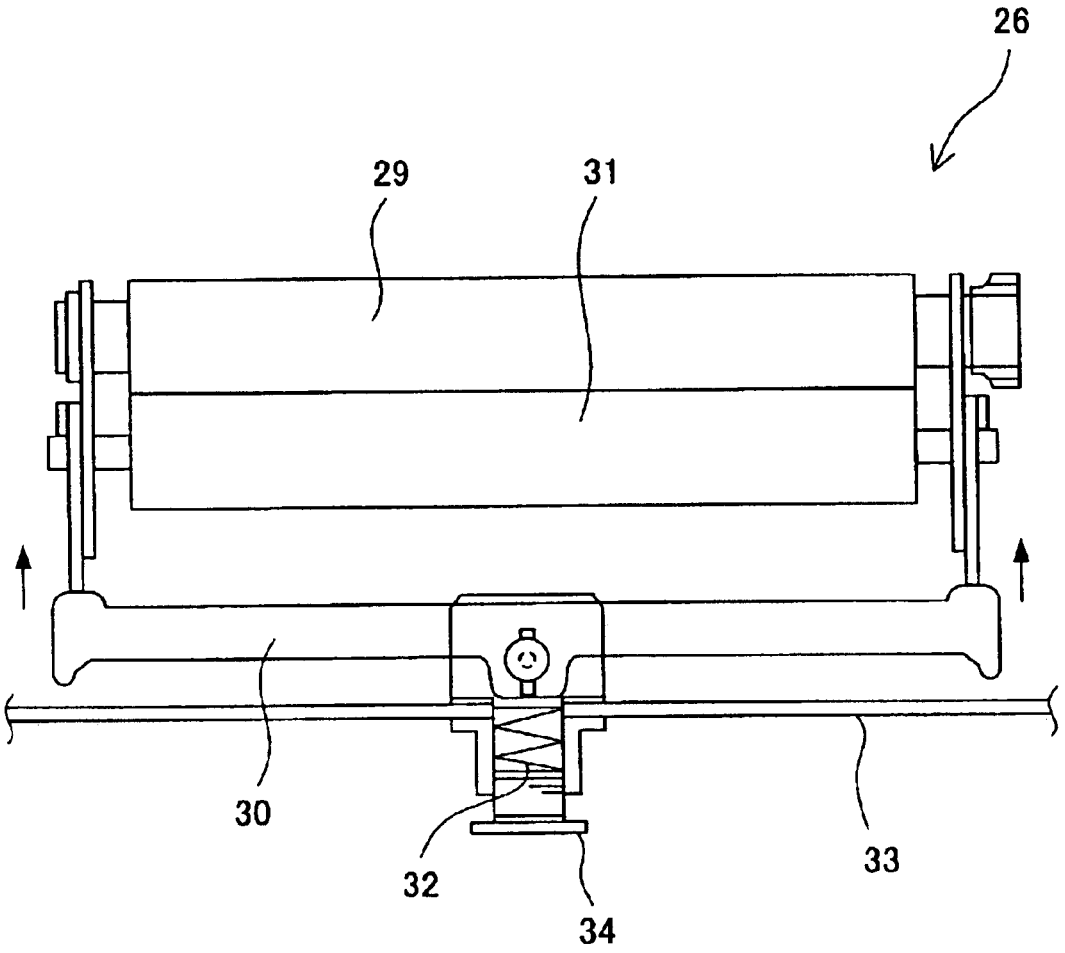
FIG. 6 is a front view showing the construction of a fuser unit of the conventional image forming apparatus of FIG. 5.

FIG. 1 shows the fuser unit 1 and its associated elements only. FIGS. 4A and 4B show a state in which the fuser unit 1 is accommodated and secured inside the housing of the image forming apparatus and a state in which the fuser unit 1 has been drawn out to one side of the housing, respectively, allowing a clear understanding of the relationship between the fuser unit 1 and the image forming apparatus.

In FIGS. 4A and 4B, the reference numeral 27 designates the aforementioned housing of the image forming apparatus, the reference numeral 28 designates a frame of the fuser unit 1. Designated by the reference numeral 3*a* is a pair of fixed elements of the guides 3 and designated by the reference numeral 3*b* is a pair of movable elements of the guides 3. More specifically, the two fixed elements 3*a* are fixed parallel to each other to the housing of the image forming apparatus close to its front and rear sides such that the movable elements 3*b* can slide back and forth along the inside of the fixed elements 3*a*. The fuser unit 1 fixed to the base plate 2 (which is not shown in FIGS. 4A–4B) is mounted on the two movable elements 3*b*. It is to be noted that the base plate 2 is not illustrated in FIGS. 4A–4B.

In the image forming apparatus thus constructed, the operating device 5 is enclosed (and kept out of sight) inside the housing 27 of the image forming apparatus as shown in FIG. 4A when the fuser unit 1 is accommodated inside the housing 27. This construction prevents accidental access to the operating device 5 by the user or other person while the apparatus is in operation. This serves to securely prevent system failures or malfunction due to inadvertent manipulation of the operating device 5 and keep the functional unit installed in position in a stable manner.

Since the peripheral part of the operating device 5 extends outward beyond the side surface of the fuser unit 1, the user or servicing personnel can easily identify the operating device 5 from above when the fuser unit 1 has been drawn out of the housing 27 as shown in FIG. 4B. Thus, the construction of the embodiment provides enhanced visibility of the operating device 5 and an improved labor efficiency in maintenance work.

Figure 2A:
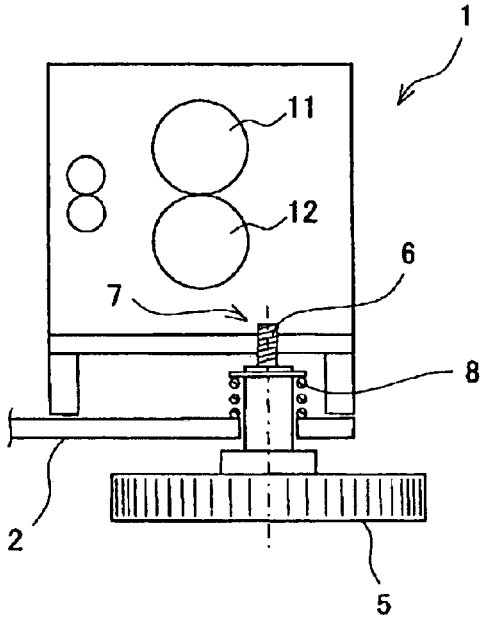
FIGS. 2A and 2B are explanatory diagrams showing the construction of a functional unit support mechanism and the construction of a comparative example, respectively.
Figure 2B:
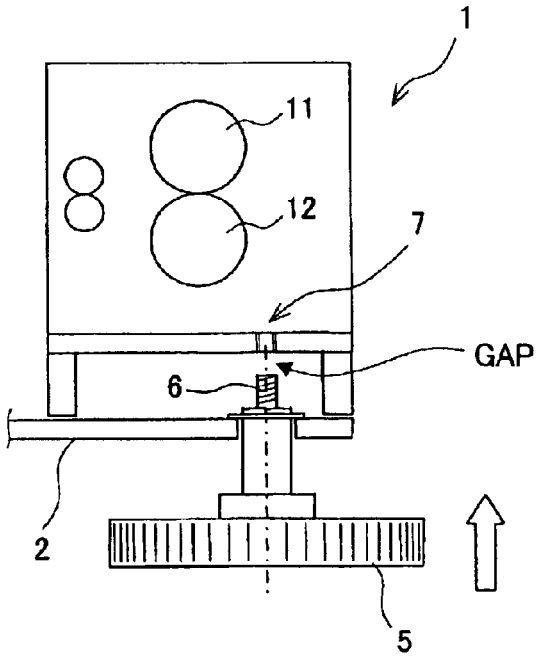

FIG. 2A shows a construction of the embodiment for securely guiding the end of the threaded shaft 6 into the threaded hole 7 formed in the bottom of the fuser unit 1, and FIG. 2B shows a comparative example in which the threaded shaft 6 is not biased upward. Since there is a gap between the far end of the threaded shaft 6 and the threaded hole 7 in the bottom of the fuser unit 1 in this comparative example, it is necessary to push the operating device 5 upward by as much as the gap and turn it in a specific direction when fixing the fuser unit 1 to the base plate 2. Obviously, the construction of the comparative example requires awkward work to be done, resulting in a poor labor efficiency in maintenance work.

In contrast, the threaded shaft 6 is biased upward by a biasing member 8, such as a coil spring, in the present embodiment as shown in FIG. 2A so that the end of the threaded shaft 6 can be fitted into the threaded hole 7 in the bottom of the fuser unit 1 by simply turning the operating device 5 in a specific direction without the need to push the operating device 5 upward by hand. It will be appreciated that this construction of the embodiment makes it extremely easy to fix the fuser unit 1 to the base plate 2.

Figure 3A:
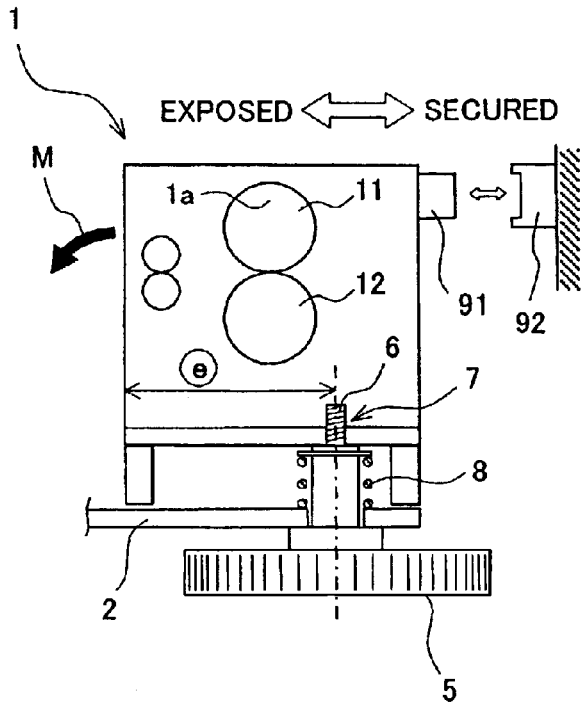
FIGS. 3A and 3B are explanatory diagrams showing the functional unit support mechanism.
Figure 3B:
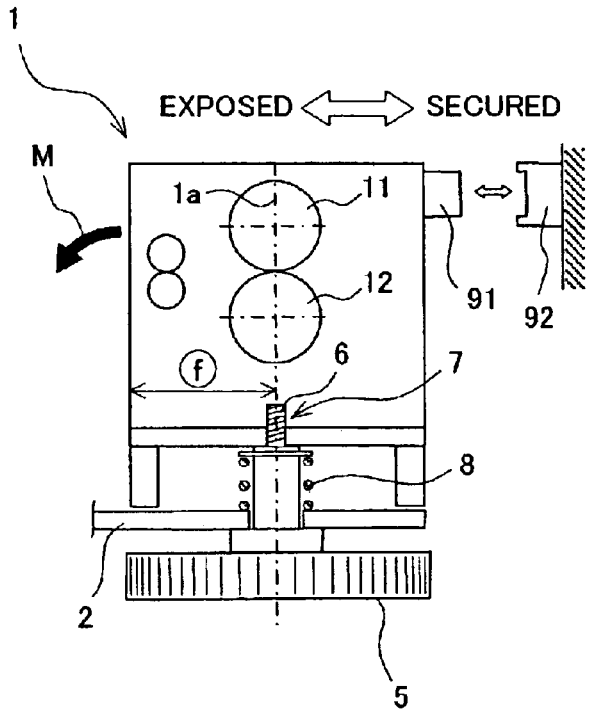

FIG. 3A shows a construction of the embodiment for ensuring stability against undesired disturbing forces such as overturning moment M acting on the fuser unit 1 mounted on the base plate 2 when the base plate 2 is pushed from its exposed position into the housing 27 of the image forming apparatus after the fuser unit 1 has been fixed to the base plate 2 as discussed above. FIG. 3B, on the other hand, shows a comparative example.

As depicted in these Figures, there are provided connectors (drawer connectors) 91, 92 on the sides of the fuser unit 1 and the housing 27, respectively, to supply electric power to a heater lamp which is a heat source for the heating roller 11 of the fuser unit 1. The connector 91 on the fuser unit side having a projecting shape fits into the connector (receptacle) 92 on the housing side having a recessed shape at the same time that the base plate 2 is pushed into the housing 27 of the apparatus. The overturning moment M acts on the fuser unit 1 mounted on the base plate 2 when it is pushed into the housing 27 this way.

If the threaded hole 7 in the bottom of the fuser unit 1 is situated on the vertical center axis 1*a* of the fuser unit 1 as shown in the comparative example of FIG. 3B, the fuser unit 1 can be securely fixed to the base plate 2. However, stability of the fuser unit 1 against the overturning moment M is more or less lost in the comparative example. This is because the length f of an arm for producing a moment of force acting clockwise (as illustrated) on the fuser unit 1 against the overturning moment M, or the distance between the vertical center axis 1*a* of the fuser unit 1 and its outer surface, is relatively small in the comparative example.

In the construction of FIG. 3A, on the other hand, the threaded hole 7 in the bottom of the fuser unit 1 is offset from its vertical center axis 1*a* in the direction in which the base plate 2 is pushed in. Thus, the length e of an arm for producing a moment of force acting clockwise (as illustrated) on the fuser unit 1 against the overturning moment M, or the distance between the vertical center axis 1*a* of the fuser unit 1 and its outer surface is relatively large compared to FIG. 3B and, therefore, this construction offers sufficiently high stability of the fuser unit 1. In the examples of FIGS. 3A and 3B, there are provided fixing legs beneath outer and inner ends of the fuser unit 1 that are mounted on the base plate 2 to allow space between the fuser unit 1 and the base plate 2 for providing the biasing member 8, such as a coil spring.

Although the invention is applied, by way of example, to the electrophotographic image forming apparatus including the detachable fuser unit 1 designed as a customer replaceable functional unit in the present embodiment, the invention is applicable to an apparatus of any type or construction combined with one or more detachable (customer replaceable) functional units.

It will be apparent from the foregoing discussion that the invention provides the following advantageous effects.

Since the end of the threaded shaft 6 located beneath the bottom of the base plate 2 is biased by the biasing member 8 toward the threaded hole 7 formed in the bottom of the functional unit (fuser unit 1) when the functional unit is placed on the base plate 2 drawn out of the housing 27 of the apparatus, it is possible to securely screw the threaded shaft 6 into the threaded hole 7 by simply turning the operating device 5. This makes it possible to fix the functional unit to the base plate 2 with enhanced ease and reliability.

Installation of the functional unit can be easily finished by pushing in the base plate 2 into the housing 27 of the apparatus, thereby joining the connectors 91, 92. Also, the base plate 2 can be easily drawn out of the housing 27, thereby disconnecting the connectors 91, 92 at the same time, and the functional unit can be removed by just turning the operating device 5 whenever necessary. This construction enables implementation of the CRU design concept, facilitating maintenance by the user.

Since the operating device 5 is hidden inside the housing 27 of the apparatus when the functional unit is pushed into the housing 27, no user intervention to the operating device 5 occurs during the operation of the apparatus. This serves to prevent system failures or malfunction due to inadvertent manipulation of the operating device 5 and keep the functional unit installed in position in a stable manner, thereby enhancing the reliability of the apparatus.

Since the peripheral part of the operating device 5 extends outward beyond the side surface of the functional unit, the user or servicing personnel can easily distinguish the operating device 5 from above when the functional unit has been drawn out of the housing 27 of the apparatus. The enhanced visibility of the operating device 5 serves to improve labor efficiency in maintenance work.

Also, because the vertical center axis 1*a* of the functional unit is positioned in line with the central axis line of the threaded shaft 6 in one form of the invention, it is possible to fixed the functional unit to the base plate 2 in a well balanced fashion.

When the base plate 2 is drawn out of the housing 27 of the apparatus for removing or installing the functional unit, the user or servicing personnel can easily identify the operating device 5 from above because the operating device 5 is so constructed that its peripheral part extends outward beyond the side surface of the functional unit to ensure improved visibility. This construction also improves operability of the operating device 5.

Furthermore, as the central axis line of the threaded shaft 6 is offset from the vertical center axis 1*a* of the functional unit in another form of the invention and the peripheral part of the operating device 5 extends outward beyond the side surface of the functional unit, the visibility of the operating device 5 is further enhanced. Therefore, the user or servicing personnel can identify the operating device 5 from above even more easily when the base plate 2 is drawn out of the housing 27 of the apparatus for removing or installing the functional unit. Also, operability of the operating device 5 is further improved with this arrangement.

As stated earlier, the central axis line of the threaded shaft 6 is offset from the vertical center axis 1*a* of the functional unit in the direction P in which the base plate 2 is pushed into the housing 27 of the apparatus. The earlier-mentioned overturning moment M acts on the functional unit when the connector 91 on the fuser unit side having the projecting shape is plugged into the connector 92 on the housing side having the recessed shape as the base plate 2 on which the functional unit is fixed is pushed into the housing 27. According to the aforementioned construction of the embodiment, however, it is possible to increase the length of an arm for producing a moment of force acting on the functional unit against the overturning moment M, or the distance between the threaded hole 7 and the outer side surface of the functional unit, whereby stability of the functional unit against the overturning moment M can be increased. Therefore, the functional unit can be fixed in a stable fashion according to the invention.

With the provision of the aforementioned base plate 2, the functional unit can be correctly-positioned and fixed to the base plate 2 drawn out of the housing 27 with great ease and reliability, resulting in an improvement in overall assembling efficiency. Also, the construction of the invention offers improved visibility of the operating device 5 when the base plate 2 is drawn out of the housing 27 of the apparatus for removing or installing the functional unit.

Even if some undesired disturbing force is exerted from the housing 27 of the apparatus on the functional unit when the base plate 2 to which the fuser unit 1 has been fixed in position is pushed into the housing 27, the fuser unit 1 mounted on the base plate 2 can be stably held in the fixed position.

Also, when the base plate 2 to which the fuser unit 1 has been fixed in position is pushed into the housing 27, the operating device 5 is hidden inside the housing 27 of the apparatus and, as a consequence, the invention securely prevents inadvertent manipulation of the operating device 5 while the apparatus is in operation. The invention also serves to prevent deterioration of reliability with respect to the positioning and fixing of the functional unit after it has been mounted on the base plate 2.

Also, the base plate 2 can be easily drawn out of the housing 27, thereby disconnecting the connectors 91, 92 at the same time, and the functional unit can be removed from the base plate 2 by just turning the operating device 5 whenever necessary. This construction enables implementation of the CRU design concept, facilitating maintenance by the user.

What is claimed is:

1. A support mechanism for detachably supporting a functional unit in a connection bay formed in a housing of an apparatus, said support mechanism comprising:

a base plate for supporting the functional unit;

an operating device provided on a bottom of the base plate and the operating device being freely turnable;

a threaded shaft provided as an integral part of the operating device;

a threaded hole formed in a bottom of the functional unit for receiving the threaded shaft and securing the functional unit to the base plate; and a biasing member elastically forcing the threaded shaft toward the threaded hole;

wherein the base plate supports the functional unit between an exposed position where the functional unit is separated from and drawn out of the connection bay such that the functional unit is exposed to an exterior of the housing and an accommodated position where the functional unit is fitted in the connection bay, the biasing member biases the threaded shaft through the base plate such that a far end of the threaded shaft is guided toward the threaded hole, and the operating device is hidden inside the housing of said apparatus when the base plate is set to the accommodated position.

2. The support mechanism according to claim 1, wherein a central axis line of the threaded shaft is positioned in line with a vertical center axis of the functional unit and a peripheral part of the operating device extends outward beyond a side surface of the functional unit.

3. The support mechanism according to claim 1, wherein a central axis line of the threaded shaft is offset from a vertical center axis of the functional unit and a peripheral part of the operating device extends outward beyond a side surface of the functional unit.

4. The support mechanism according to claim 1, wherein a central axis line of the threaded shaft is offset from a vertical center axis of the functional unit in a direction in which the base plate is pushed into the accommodated position of the functional unit.

5. The support mechanism according to claim 1, wherein said biasing member being a coil spring for eliminating pushing of the operating device upwardly into the threaded hole.

6. An image forming apparatus comprising:

an image forming unit for at least forming an image scanned from an original document; and a support mechanism for detachably supporting a functional unit in a connection bay formed in a housing of said apparatus, said support mechanism including a base plate for supporting the functional unit;

an operating device provided on a bottom of the base plate and being freely turnable;

a threaded shaft provided as an integral part of the operating device;

a threaded hole formed in the bottom of the functional unit to allow the threaded shaft to be screwed in to secure the functional unit to the base plate; and a biasing member elastically forcing the threaded shaft toward the threaded hole;

wherein the base plate supports the functional unit between an exposed position where the functional unit is separated from and drawn out of the connection bay such that the functional unit is exposed to an exterior of the housing and an accommodated position where the functional unit is fitted in the connection bay, the biasing member biases the threaded shaft through the base plate such that a far end of the threaded shaft is guided toward the threaded hole, and the operating device is hidden inside the housing of said apparatus when the base plate is set to the accommodated position.

7. The image forming apparatus according to claim 6, wherein a central axis line of the threaded shaft is positioned in line with a vertical center axis of the functional unit and a peripheral part of the operating device extends outward beyond a side surface of the functional unit.

8. The image forming apparatus according to claim 6, wherein a central axis line of the threaded shaft is offset from a vertical center axis of the functional unit and a peripheral part of the operating device extends outward beyond a side surface of the functional unit.

9. The image forming apparatus according to claim 6, wherein a central axis line of the threaded shaft is offset from a vertical center axis of the functional unit in a direction in which the base plate is pushed into the accommodated position of the functional unit.

10. The image forming apparatus according to claim 6, wherein said biasing member being a coil spring for eliminating pushing of the operating device upwardly into the threaded hole.

* * * * *